US005287828A

United States Patent [19]

Kennedy

[11] Patent Number: 5,287,828

[45] Date of Patent: Feb. 22, 1994

[54] ENGINE INTAKE FLOW BOOSTER

[76] Inventor: Michael D. Kennedy, 417 Walnut Grove Rd., Archdale, N.C. 27263

[21] Appl. No.: 44,454

[22] Filed: Apr. 9, 1993

[51] Int. Cl.[5] ..... F02M 29/00

[52] U.S. Cl. ..... 123/52 M; 123/590; 261/78.1; 261/DIG. 55

[58] Field of Search ..... 123/52 M, 590; 261/78.1, DIG. 55

[56] References Cited

U.S. PATENT DOCUMENTS 3,366,145 1/1968 Lohn ..... 123/52 M
4,015,574 4/1977 Hanff ..... 123/590
4,415,507 11/1983 Voliva ..... 123/590
5,046,475 9/1991 Thompson ..... 123/590

*Primary Examiner*—Tony M. Argenbright
*Assistant Examiner*—M. Macy
*Attorney, Agent, or Firm*—Walter L. Beavers

[57] ABSTRACT

An intake flow booster is provided for insertion between the carburetor and intake manifold of an internal combustion engine which includes a series of downwardly depending tubes having an internal frustro-conical shape. The fuel/air mixture leaving the carburetor passes through a well in the manifold plate and into the manifold tubes whereby the mixture flows more efficiently to the engine providing a higher performance and greater horsepower.

12 Claims, 3 Drawing Sheets

ENGINE INTAKE FLOW BOOSTER

BACKGROUND OF THE INVENTION

1. Field Of The Invention

The invention herein pertains to a device to improve the efficiency and increase the power of an internal combustion engine and particularly to an intake flow booster to improve the performance of the engine at a partial throttle opening.

2. Description Of The Prior Art And Objectives Of The Invention

Manufacturers for many years have attempted to improve the power output of internal combustion engines in order to utilize a smaller size engines having the same or greater horsepower than larger engines in order to save materials, space and weight. In certain applications such as in aircraft and boats only limited space is available and the horsepower developed by an engine is of prime importance. In certain applications, such as in aircraft, weight and size limitations of the engines are of utmost importance whereas in automobiles the operating efficiency and fuel economy are major concerns of both manufacturers and operators alike.

Various types of fuel saving devices have been conceived in the past such as carburetor adapters to improve the homogenization of the air/gas mixture before it reaches the firing chambers. Other devices have been conceived which are an attempt to improve the fuel efficiency of the engines as set forth in U.S. Pat. No. 4,409,951. Other carburetor modification devices are shown in U.S. Pat. Nos. 3,966,430; 4,019,483; 4,092,966 and 4,281,632.

While the above-identified devices have provided useful and advantageous under certain circumstances, such prior devices generally work on the principal of increasing the air/fuel mixture speed but with a loss in total air/fuel flow. This will greatly reduce the power of the engine at full throttle.

With these and other shortcomings of previous devices known, the present invention was conceived and one of its objectives is to provide a device which increase the air/fuel flow into the combustion chamber and which will provide more horsepower from the engine at full throttle.

It is another objective of the present invention to increase the air/fuel flow whereby the engine can operate at a higher horsepower at a particular throttle opening, therefore burning less fuel and providing greater efficiency.

It is still another objective of the present invention to provide an intake flow booster for positioning between the carburetor and intake manifold which will make the internal combustion engine more efficient under all operating conditions.

SUMMARY OF THE INVENTION

The aforesaid and other objectives are realized by providing an intake flow booster which can be configured for single or multi-barrel carburetors of internal combustion engines having cylinders. The flow booster as described is positioned between the carburetor and the manifold body, particularly the intake manifold. The device includes a relatively thick planar manifold plate having a "depression" or well therein and one or more manifold tubes are positioned at the bottom of the well to allow the air/fuel mixture to pass therethrough. The number of manifold tubes provided depend on the number of carburetor barrels. For example, a single barrel carburetor will have a single tube whereas a four barrel carburetor will require four manifold tubes. The carburetor is affixed, usually by bolts to the top of the booster manifold plate and the tubes extend downwardly, and are positioned within the intake manifold. The tubes may be of a length sufficient to extend substantially within the intake manifold but do not contact the inside bottom of the intake manifold. Each tube has a substantially frustro-conical inner passageway to provide a diameter reduction approximately midway along the internal passageway of the tube. The inside ends of the tube wall are thereby flared. It has been found that the intake flow booster of the invention will improve the engine performance and horsepower while decreasing fuel consumption. It has been further found that the device is extremely effective at a partial throttle openings such as at sixty percent.

DESCRIPTION OF THE PREFERRED EMBODIMENT

Figure 2:
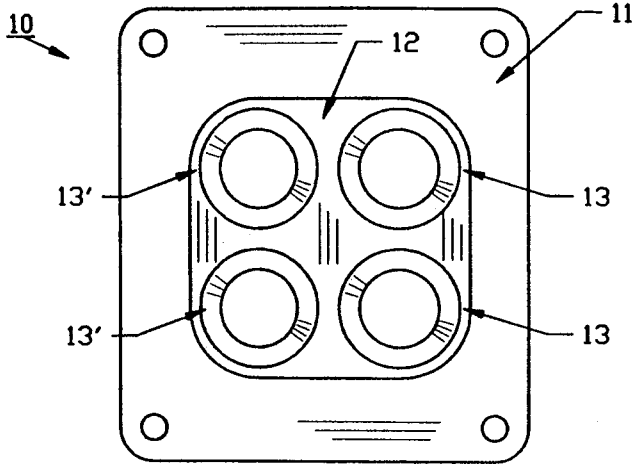
FIG. 2 demonstrates a top plan view of the invention as shown in FIG. 1.
Figure 1:
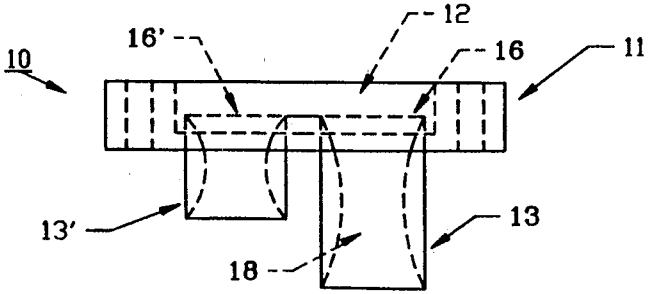
FIG. 1 demonstrates an intake flow booster of the invention for a four barrel carburetor in a side elevational view.
Figure 1A:
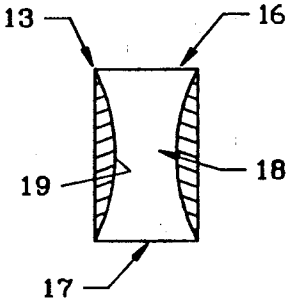
FIG. 1A shows a cross-sectional view of a manifold tube as seen in FIG. 1 but removed from the manifold plate.

The preferred form of the invention is shown in FIGS. 1, 1A and 2 whereby an intake flow booster is configured for a four barrel carburetor. As shown in FIG. 1, the left side manifold tubes have a somewhat shorter length than the right side tubes, to conform to the particular two plane intake manifold used therewith. As shown, the rectangular shaped manifold plate has a depression or well 12, also substantially rectangular shaped which extends across the major portion of the manifold plate approximately 0.5 inches in depth. Well 12 has a greater area through the top of tubes 13, 13' and is wider than the combined tubes. The carburetor which bolts onto the flow booster is therefore spaced approximately one-half inch from the upper manifold tube ends which communicate with the top of the well and extend downwardly for positioning within the intake manifold. As shown in FIG. 1A, the inside walls of the manifold tubes have a somewhat frustro-conical configuration having a diameter reduction of approximately twenty percent and forming a restriction in the tube approximately midway therealong. Thus the fuel/air mixture which exits the carburetor enters the well in the manifold plate of the flow booster where it is directed into one of the four manifold tubes where it then passes into the intake manifold and continues to the combustion chamber of the engine. The preferred embodiment herein describes the intake flow booster as would be used for a four barrel carburetor although a single or other multi-barrel carburetors could be used, other than the four barrel described.

DETAILED DESCRIPTION OF THE DRAWINGS AND OPERATION OF THE INVENTION

Figure 3:
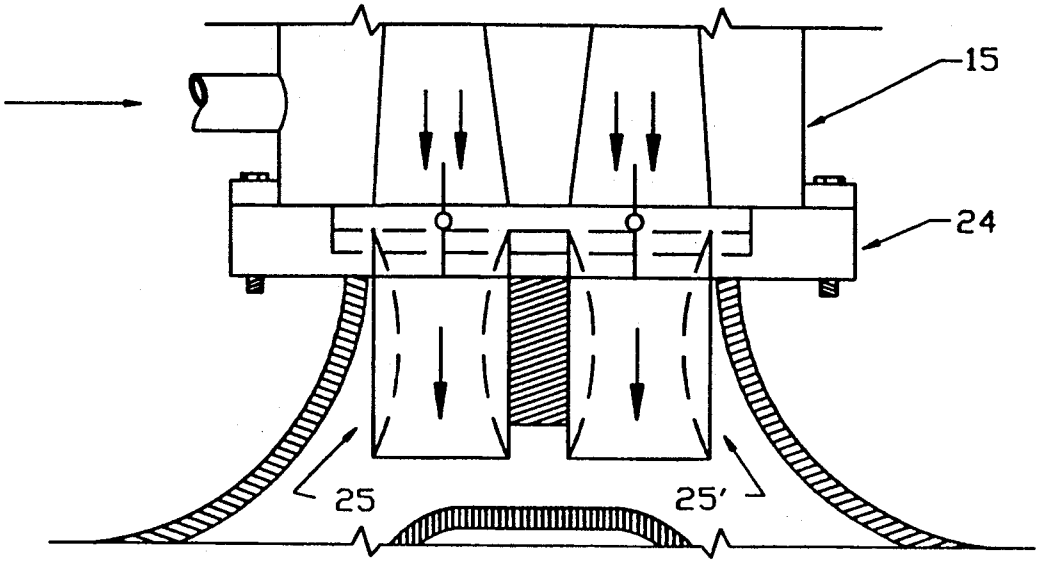
FIG. 3 illustrates another embodiment of the invention positioned on an internal combustion engine intake manifold utilizing a two barrel carburetor.

For a more complete understanding of the invention, turning now to the drawings, intake flow booster 10 configured for a four barrel carburetor of a typical internal combustion engine is shown in FIGS. 1, 2 and 3. In FIG. 1, flow booster 10 includes a thick, rectangular planar manifold plate 11 which defines a rectangular well or depression 12 which is approximately 0.5 inches deep. Plate 12 is approximately 0.75 inches thick and is formed of steel or other suitable materials. In FIG. 2, four manifold tubes 13, 13' communicate at their upper ends 16, 16' with plate well 12 and extend downwardly therefrom. Manifold tubes 13, 13' as shown in FIG. 1 may have different or the same lengths for various intake manifold designs. As seen in FIG. 1A, tube 13 in cross-sectional representation demonstrates a substantially frustro-conical inside wall surface 19 forming a somewhat restricted air passage at approximately the middle of the length of tube 13. The internal passageway 18 is reduced in diameter approximately twenty percent at the middle of tube 13. As further seen, top or upper end 16 and lower or bottom end 17 is flared. It has been found that this particular configuration in conjunction with plate well 12 improves the overall engine performance due to the fuel/air mixture passage therethrough. As would be understood, the invention as illustrated provides a separate engine intake flow booster which is attached to the engine. However, the intake flow booster could be integrally formed with the manifold as part thereof.

In FIG. 3 a schematic intake manifold 14 is shown with two barrel carburetor 15 and having intake flow booster 24 therebetween. Manifold tubes 25, 25' extend into manifold 14 as earlier discussed. Manifold 14 comprises a single plane manifold, thus manifold tubes 25, 25' have the same length.

Figure 4:
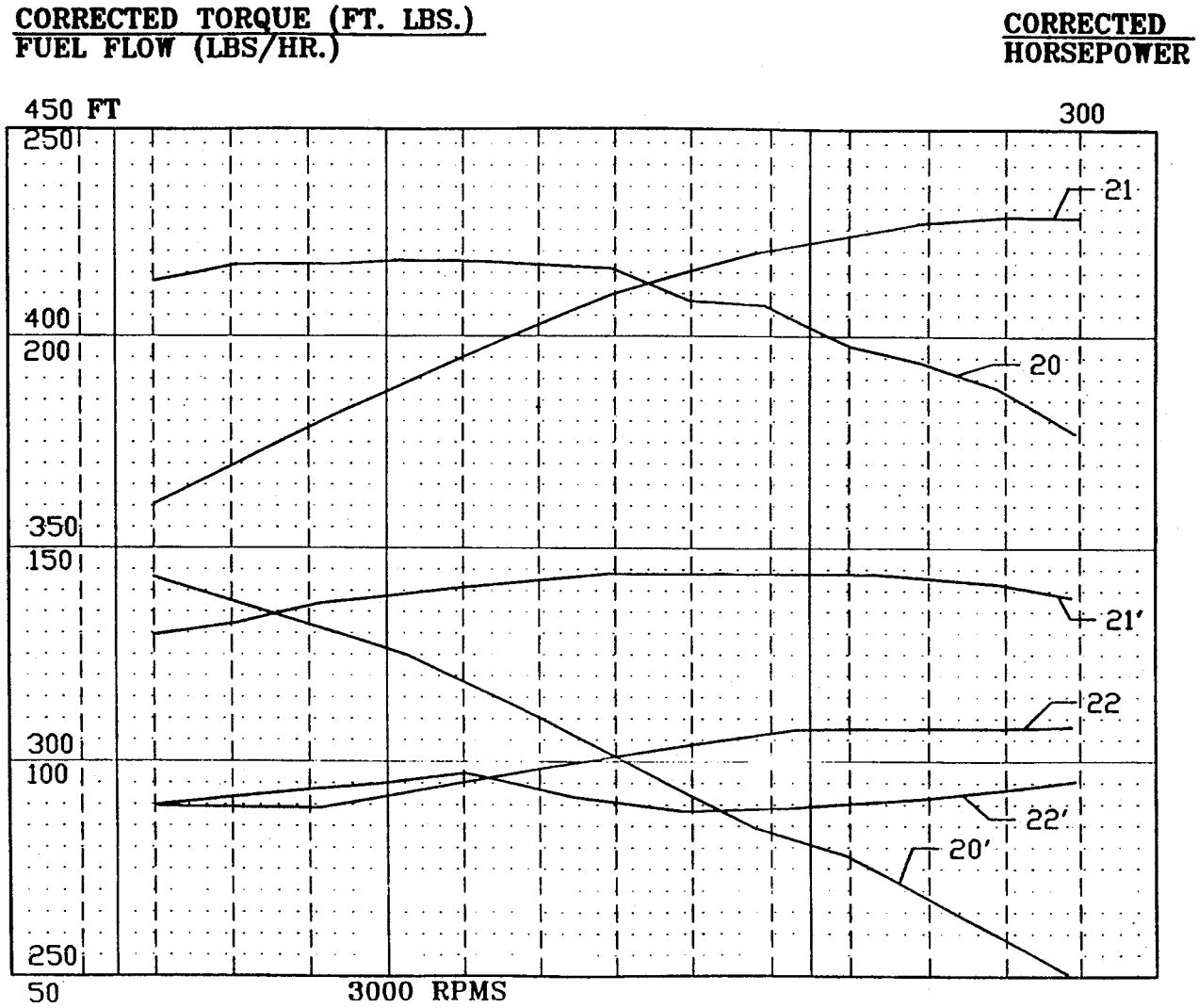
FIG. 4 demonstrates a comparison performance chart of an internal combustion engine with and without the intake flow booster utilized.

For a graphic illustration of the improved performance of the improved engine performance by utilizing the intake flow booster of the invention, FIG. 4 illustrates the performance of an internal combustion engine, more specifically a 330 horsepower Mercury Cruiser engine of 454 cubic inches. The data provides averages from 2700 rpms to 3500 rpms with a partial throttle test (approximately sixty percent of full throttle). As shown, lines 20, 21 and 22 demonstrate test results with the intake flow booster of the invention whereas lines 20', 20', 21' and 22' demonstrate the performance without the flow booster of the invention. As seen, by comparing lines 20, 20' the engine torque is much higher. Lines 21, 21' demonstrate the horsepower which illustrate a much higher horsepower and the pounds of fuel consumed per hour as shown at lines 22, 22' show a lesser fuel consumption and greater engine efficiency beginning above 3000 rpms by using intake flow booster 10.

As would be understood, the intake flow booster as shown herein could be utilized for any of a variety of single or multi-barrel carburetors of internal combustion engines and intake manifold designs. The illustrations and examples provided herein are for explanatory purposes and are not intended to limit the scope of the appended claims.

I claim:

1. An intake flow booster for an internal combustion engine for location between the carburetor and intake manifold, comprising a manifold plate, said plate defining a single well, a manifold tube wherein said well is wider foam said tube to be inserted into the intake manifold, said tube also being in fluid communication with and surrounded by said well, said tube having an internal nozzle configuration wherein an outlet end 56 said tube is whereby fluid passing through said carburetor will be smoothly directed through said well and said tubes for delivery through said intake manifold for combustion purposes.

2. An intake flow booster as claimed in claim 1 and including a plurality of manifold tubes, said plurality of manifold tubes being surround by said single well.

3. An intake flow booster as claimed in claim 2 wherein said manifold plate and said manifold tubes are integrally formed.

4. The intake flow booster of claim 1 wherein said manifold tube is configured to restrict the air flow between the ends of said tube.

5. The intake flow booster of claim 1 wherein said well has a depth of approximately one-half inch.

6. The intake flow booster of claim 1 wherein said manifold tube has a frustro-conical configuration.

7. An intake flow booster for an internal combustion engine for location between the carburetor and intake manifold comprising: a manifold plate, said plate defining a single well, a plurality of manifold tubes, each of said tubes having a restricted passageway between the ends thereof with outlet ends being flared, said manifold tubes being in fluid communication with and surrounded by said well to allow a fuel mixture from said carburetor to pass therethrough and into said intake manifold, each of said manifold tubes having an internal frusto-conical configuration.

8. An intake flow booster as claimed in claim 7 wherein said plurality of manifold tubes comprise two tubes.

9. An intake flow booster as claimed in claim 7 wherein said plurality of manifold tubes comprise three tubes.

10. An intake flow booster as claimed in claim 7 wherein said plurality of manifold tubes comprise four tubes.

11. The intake flow booster of claim 7 wherein said manifold tubes extend into said intake manifold.

12. An intake flow booster for an internal combustion engine located within the intake manifold comprising: a manifold plate, said plate defining a single well, a manifold tube, said tube to be inserted into the intake manifold, said tube in fluid communication with and surrounded by said well, said tube having an internal restricted passageway with the ends of said tube flared whereby fluid will be directed through said well and said tube for delivery into said intake manifold for combustion purposes.

* * * * *